United States Patent [19]

Thalenfeld

[11] Patent Number: 4,871,135

[45] Date of Patent: Oct. 3, 1989

[54] TWO-PART SHELF HOOK

[75] Inventor: David R. Thalenfeld, Bear Creek, Pa.

[73] Assignee: Trion Industries Inc., Wilkes-Barre, Pa.

[21] Appl. No.: 264,151

[22] Filed: Oct. 28, 1988

[51] Int. Cl.[4] ..... G09F 3/18

[52] U.S. Cl. ..... 248/221.4; 40/124.1; 211/57.1; 248/222.3; 248/225.1; 248/309.2

[58] Field of Search ..... 248/221.4, 225.1, 222.3, 248/309.2; 40/650, 651, 658, 124.1; 211/57.1

[56] References Cited

U.S. PATENT DOCUMENTS

| | | | |
|---|---|---|---|
| 1,027,710 | 5/1912 | Ette | 248/222.3 |
| 2,927,701 | 3/1960 | Lynde, Jr. | 248/221.4 X |
| 3,214,122 | 10/1965 | Fredericksen | 248/221.4 |
| 3,588,020 | 6/1971 | Newcomer | 248/222.3 |
| 3,815,756 | 6/1974 | Cox | 248/221.4 X |
| 4,526,335 | 7/1985 | Garfinkle | 248/221.4 |
| 4,706,917 | 11/1987 | Thalenfeld . | |

FOREIGN PATENT DOCUMENTS

| | | | |
|---|---|---|---|
| 2037633 | 2/1972 | Fed. Rep. of Germany | 40/650 |

OTHER PUBLICATIONS

Art Phyl Creations Document, p. 21.

*Primary Examiner*—Alvin C. Chin-Shue
*Assistant Examiner*—David L. Talbott
*Attorney, Agent, or Firm*—Schweitzer & Cornman

[57] ABSTRACT

A merchandise display hook is disclosed, which includes a base member of springy sheet metal, formed into a U-shape, with the open side of the U-shape facing inward for mounting on a price tag molding along the front edge of a shelf. A wire-like display hook member has a vertical support portion mounted by means of two aligned openings in the base. A projection on the support portion, when aligned with notches in the openings, allows assembly of the two parts when the hook is rotated to extend rearwardly. With the parts thus oriented, and the upper and lower arms of the base member squeezed together, the parts may be quickly and easily permanently assembled. The new arrangement facilitates on-site assembly of the hooks by the user and enables significant reduction in the cost of manufacture and marketing without compromise of product quality or performance.

4 Claims, 2 Drawing Sheets

TWO-PART SHELF HOOK

BACKGROUND AND SUMMARY OF THE INVENTION

In connection with the display of merchandise in supermarkets and the like, one of the well known types of display hook is designed to be mounted on the price tag molding, frequently found extending along the front edge of a store shelf. The price tag molding typically is an elongated extrusion having inwardly directed upper and lower flanges arranged to receive the upper and lower marginal edges of price tags, for the pricing of merchandise located directly behind on the shelf. For special displays, display hooks, sometimes referred to as "J hooks" are arranged to be mounted on the price tag molding, projecting outward therefrom. Typically, such display hooks comprise a base member, formed of springy sheet metal formed into the shape of a U. The two arms of the U are horizontally directed and are provided with outwardly bent flange portions arranged to be received within the inwardly directed flanges of a price tag molding.

In a conventional hook of the type descried, the upper and lower arms of the sheet metal base member typically are formed with vertically aligned openings for the reception of a wire-like merchandise display hook. In the manufacture of the hook assembly, the wire-like display hook member is formed with a vertically extending support portion which extends downward through the aligned openings in the base member. As part of the assembly operation, the wire is "staked" just below the upper and lower arms of the base member, forming outwardly projecting tabs which lock the wire member in its assembled position with respect to the base member. In the finished device, the wire-like display hook is able to pivot from side to side about the vertical axis of its support portion, while being permanently assembled with the base member by reason of the staked tab portions above and below the base member. A prior art example of a hook of the general type described is shown in the Cox U.S. Pat. No. 3,815,756, which shows the wire support portion staked above as well as below the base member. In a more common design of the J hook device, the assembled wire is staked only at the bottom (i.e., below the lower arm of the base member). This is adequate in most cases, since the wire-like display hook member normally has a portion bent at right angles to the support portion and extending forwardly for the support of display merchandise, eliminating the need for forming a tab at the top.

The present invention is directed to a merchandise display hook of the general type described above, but which incorporates significant improvements in design and construction enabling exceptional reduction in manufacturing and marketing costs to be realized. More particularly, the invention is directed to a novel and improved merchandise display hook for mounting on a price tag molding or the like, which is designed and constructed for on-site assembly of the merchandise hook member to the base member. The device of the invention, while accommodating on-site assembly of the base and hook components, is also constructed in such a manner that unintended separation of these elements is effectively precluded.

By virtue of the invention, significant reductions are realized in manufacturing and marketing costs, so that the product may be supplied to the end user at a cost significantly below that of conventional devices, with no sacrifice of quality or performance. The cost savings are sufficiently great as to far outweigh the few seconds required of the user in assembling the parts at the site of use.

For a better understanding of the above and other features and advantages of the invention, reference should be made to the following detailed description of a preferred embodiment and to the accompanying drawings.

DESCRIPTION OF PREFERRED EMBODIMENTS OF THE INVENTION

Figure 1:
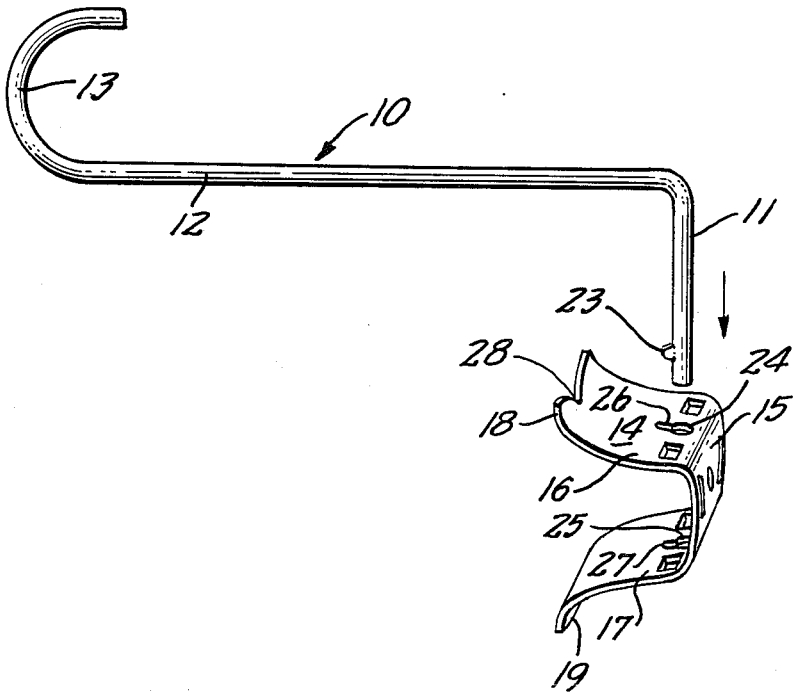
FIG. 1 is an exploded perspective view illustrating the two principal parts of the new hook, in disassembled relation but oriented properly for assembly.
Figure 2:
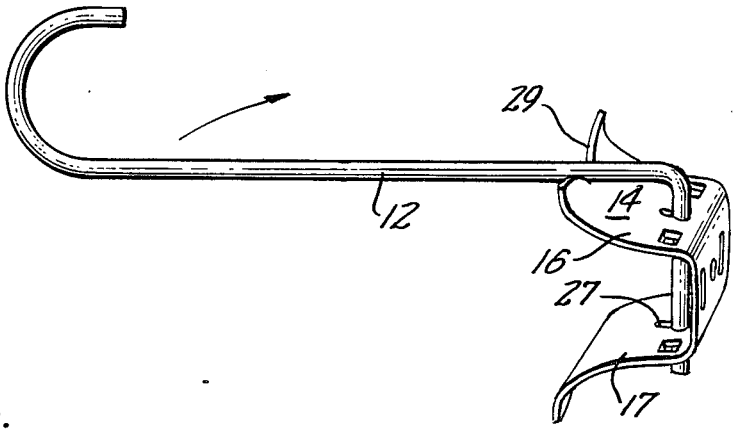
FIG. 2 is a perspective view of the parts of FIG. 1, with the parts partially assembled.
Figure 3:
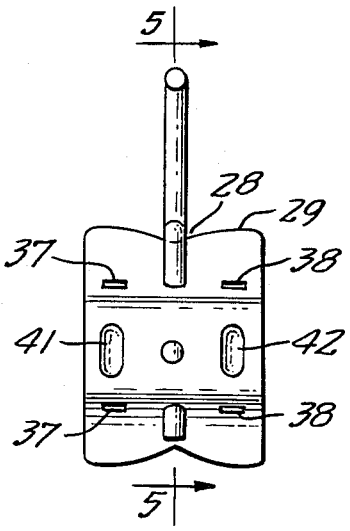
FIG. 3 is a front elevational view of the partly assembled device of FIG. 2.
Figure 4:
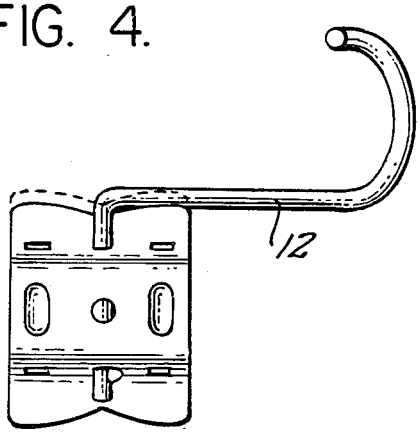
FIG. 4 is a view similar to FIG. 3, showing the hook in a further stage of partial assembly.
Figure 5:
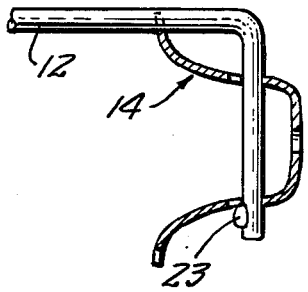
FIG. 5 is a fragmentary cross sectional view as taken generally on line 5—5 of FIG. 3.

Referring now to the drawing, the reference numeral 10 designates generally a merchandise hook element, typically formed of steel wire. The display hook includes a generally vertical support portion 11 joined integrally at its upper end to a generally horizontal display portion 12 adapted for supporting carded merchandise or the like in a well known c manner. At its outer end, the display portion 12 is provided with an upwardly bent portion 13. In the form of the invention illustrated in FIGS. 1–4, the bent portion 13 is in the form of a U-shaped bend, providing a blunt outer end portion. The specific form of the display portion 12 and/or the upwardly bent portion 13 is not, however, in any way critical to the invention.

The display hook portion is arranged to be supported by a base member 14, formed of springy sheet material, typically a spring steel of about 25 mils in thickness. The base member 14 is formed generally in the shape of a "U", being provided with a generally vertical front surface 15, forming the "bottom" of the "U" shape, and upper and lower arms 16, 17. At their extremities, the arms 16, 17 are formed with outwardly projecting flanges 18, 19. These are adapted for reception within upper and lower channels 20, 21 of a price tag molding 22 mounted at the forward edge of a display shelf 23. The price tag molding 22 is entirely conventional and forms no part of the invention. Likewise, the general arrangement for mounting of the base member 14 by its flanges 18, 19 in the price tag molding is well known in the art.

Figure 6:
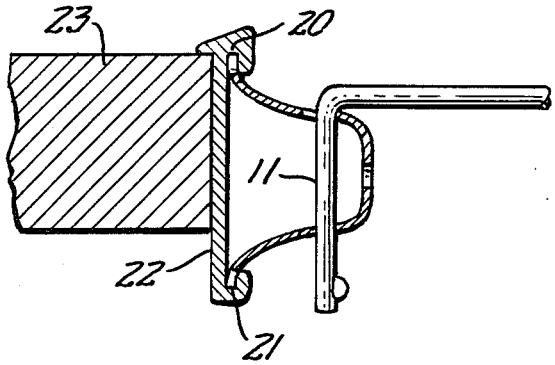
FIG. 6 is a cross sectional view, taken at a location similar to FIG. 5, but showing the hook in a fully assembled condition and mounted on a price tag molding.

In display hooks of the general type illustrated, constructed along conventional principles, the display hook D member is assembled to the base member substantially in the manner shown in FIG. 6, by passing of the vertical support portion 11 through vertically aligned openings in the base member. After a preliminary assembly as described, a portion of the support member 11, projecting below the base member, is staked or otherwise deformed, so that it cannot later be separated from the base member. While the functioning of such a conventionally assembled device is quite adequate, the assembly operations, particularly the staking operation after preliminary assembly, are time consuming manual operations that add significantly to the cost of manufacturing of the device.

Pursuant to the present invention, the support portion 11 of the display hook is provided, during the wire forming operations, with a radially extending projection 23. Typically, this may be easily formed by a simple staking operation that it locally deforms the wire and results in the desired radial projection. Because this operation is performed during the wire-forming stage, it can be easily and automatically carried out.

In conjunction with the pre-formed projection 23, the sheet metal base member 14 is provided with a pair of vertically aligned openings 24, 25, which are principally circular but which are provided with radial notches 26, 27 of a size and shape to accommodate the radial projection 23 formed on the wire. Pursuant to the invention, the orientation of the radial notches 26, 27, the radial projection 23, and the display portion 12 of the hook member is such that, when the projection 23 is lined up with the notches 26, 27, the display portion 12 of the hook is extending in a generally rearward direction.

To particular advantage, the flanges 18, 19 of the base member may be provided with a central V-shaped notch 28. This forms a recess for receiving the display portion 12 of the wire when the wire is initially assembled with the base. When the wire member 12 is subsequently pivoted, the upper surfaces 29 of the notched flanges serve as camming surfaces to facilitate resilient displacement of the arm of the base member in order for the wire to clear the side edges of the flange.

Ideally, the geometry of the base member 14, and the location of the radial wire projection 23 is such that, when the display portion 12 of the wire rests in the bottom of the "V" notch 28, the radial projection 23 is located just slightly below the lower arm 27. This facilitates the assembly operation by requiring only minimum (or perhaps no) initial squeezing together of the arms of the base member, and the necessary further displacement of the upper arm 16 is augmented by the camming action of the V-shaped recess 28. As soon as the display portion 12 of the wire clears the outer edge of the base member, the resilient sheet metal material of the base springs back to its normal configuration, which prevents accidental return of the display hook member 10 to a rotational orientation in which it can be separated from the base member. Thus, while it is possible for the wire and the base member to be later intentionally separated, they are for practical purposes permanently assembled.

As reflected in the drawings, the base member 14 is advantageously configured in a symmetrical fashion, so that the wire support element 11 may be inserted from either side during the assembly operation.

When the device of the invention is installed on a shelf, as shown in FIG. 6, the presence of the shelf itself also precludes rotation of the wire member beyond about 90 degrees from a forwardly extending position, so that an installed hook cannot under any circumstances be separated from its base member.

Figure 7:
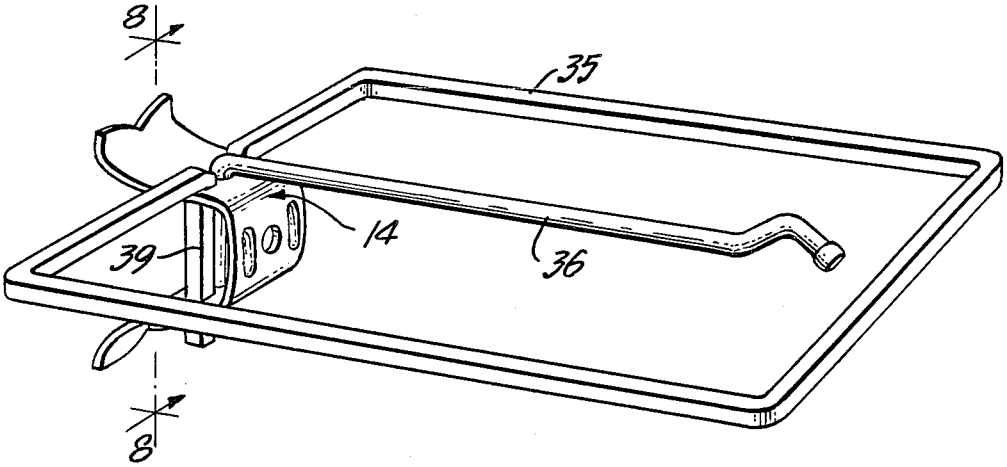
FIG. 7 is a perspective view of a merchandise display hook according to the invention, shown having mounted thereon a plastic guard member for protecting the hook against accidental contact.
Figure 8:
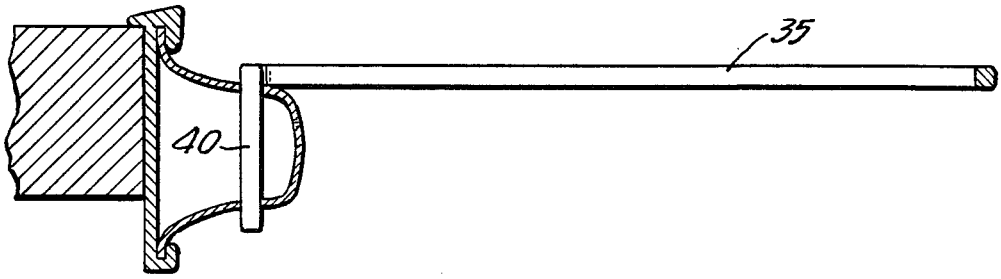
FIG. 8 is a cross sectional view, as taken generally on line 8—8 of FIG. 7.

As reflected in FIG. 7 and 8, the assembly of the invention is fully adaptable to the use of conventional guard devices and the like. In FIG. 7 and 8, a molded plastic guard member 35, of generally rectangular shape, is positioned in surrounding relation to the forwardly extending portion 36 of a merchandise display hook mounted on base member 14. For this purpose, the base member is provided with pairs of vertically aligned openings 37, 38 for the reception of downwardly projecting legs 39, 40. Where desired, the guard 35 may be formed of metal, in which case it may be advantageous to permanently assemble the base and guard. Weld bumps 41, 42 (see FIG. 3) are provided for this purpose.

The device of the invention represents a significant improvement over known constructions of similar hooks, in that it enables the hooks to be manufactured, packaged and shipped in separate pieces. Because the stacking of the wire element can be performed as part of the wire-forming process, and not as a manual operation after assembly of the wire to the base member, the savings in manufacturing costs are very significant indeed. With the device of the invention, the user may very quickly and easily assemble the two-part hook by inserting the hook in a "backwards" orientation into the base member, and then rotating the hook to its normal, forwardly extending orientation. The shallow, V-shaped notches 28 in the outer flanges of the base member greatly facilitate this operation. At the same time, once the wire member clears the side of the base member, it cannot return to the assembly/disassembly orientation unless the base member is deliberately squeezed with substantial force.

It should be understood, of course, that the specific forms of the invention herein illustrated and described are representative only as certain changes may be made therein without departing from the clear teachings of the disclosure. Accordingly, reference should be made to the following appended claims in determining the full scope of the invention.

I claim:

1. A two-part swivel hook for installation in a shelf tag rail or the like and the type comprising a base member of springy sheet-like material formed in a generally U-shaped configuration in which the closed end of the U-shaped forms the front wall of the base member and spaced upper and lower arms, forming the open end of the U-shape, project toward the tag rail, said arms having flange means for interengagement with tag holding flanges of the tag rail, a wire-like display hook member including a generally vertically extending support portion and an integral angularly extending display portion for supporting display articles, and aligned openings in the upper and lower arms of said base member for the reception and swivel mounting of said support portion, the improvement characterized by (a) both of said aligned openings being provided with radially outwardly projecting notches, (b) said support portion having a radial projection thereon of a size and shape to enable its passage through said openings only when aligned with said notches, (c) at least the lower one of said notches and said projection being so oriented with respect to said display portion as to be align-d only when said display portion is in a predetermined, generally rearwardly directed orientation with respect to said base member, (d) said projection being positioned on said support portion so as to be located below the lower one of the arms of said base member when said display hook member and said base member are assembled, whereby to preclude disassembly of said hook member from said base member unless said hook member is in said predetermined rearwardly directed orientation, (e) said lower notch, said radial projection, and said display portion being so oriented that said display portion projects rearwardly over said flange means when said radial projection and said lower notch are aligned for assembly, (f) the spacing between the upper and lower arms of said base member, and the height of the flange means on said upper arm, being so related to the length of said support portion and the location thereon of said radial projection, that said arms must be resiliently squeezed toward each other to permit passage of said radial projection through the opening in said lower arm, (g) said display portion, after being pivoted away from its assembly orientation, being blocked from returning thereto by the flange means on said upper arm.

2. A swivel hook according to claim 1, further characterized by (a) the flange means on said upper arm being notched in a position to accommodate said display portion when said display portion is oriented to effect alignment of said radial projection with said notches.

3. A swivel hook according to claim 2, further characterized by (a) said base member being of generally symmetrical configuration, whereby said display hook member may be assembled from either side of said base member.

4. A two-part swivel hook for installation in a shelf tag rail or the like and of the type comprising a base member of springy sheet-like material formed in a generally U-shaped configuration in which the closed end of the U-shape forms the front wall of the base member and spaced upper and lower arms, forming the open end of the U-shaped, project toward the tag rail, said arms having flange means for interengagement with tag holding flanges of the tag rail, a wire-like display hook member including a generally vertically extending support portion and an integral angularly extending display portion for supporting display articles, and aligned openings in the upper and lower arms of said base member for the reception and swivel mounting of said support portion, the improvement characterized by (a) at least the lower one of said openings being provided with a radially outwardly projecting notch, (b) said notch being so oriented with respect to said display portion as to be aligned with said projection only when said display portion is in a predetermined, generally rearwardly directed orientation with respect to said to said base member, (c) said support portion having a radial projection thereon of a size and shape to enable its passage through said lower opening only when aligned with said notch, (d) said projection being positioned on said support portion so as to be located below the lower one of the arms of said base member when said display hook member and said base member are assembled, whereby to preclude disassembly of said hook member from said base member unless said hook member is in said predetermined rearwardly directed orientation, (e) said notch, said radial projection, and said display portion being so oriented that said display portion projects generally rearwardly over said flange means when said radial projection and said notch are aligned for assembly, (g) the spacing between the upper and lower arms of said base member, and the height of the flange means on said upper arm, being so related to the length of said support portion and the location thereon of said radial projection, that said arms must be resiliently squeezed toward each other to permit passage of said radial projection through the opening in said lower arm, (h) said display portion, after being pivoted away from its assembly orientation, being blocked from returning thereto by the flange means on said upper arm.

* * * * *